US006752678B1

(12) United States Patent
Chuang

(10) Patent No.: US 6,752,678 B1
(45) Date of Patent: Jun. 22, 2004

(54) COMBINATION PUZZLE TOY

(76) Inventor: Chao-ken Chuang, No. 46, Shin Leh Rd., Tainan City (TW)

( * ) Notice: Subject to any disclaimer, the term of this patent is extended or adjusted under 35 U.S.C. 154(b) by 0 days.

(21) Appl. No.: 10/683,843

(22) Filed: Oct. 9, 2003

(51) Int. Cl.[7] ..... A63F 9/12
(52) U.S. Cl. ..... 446/69; 273/157 R
(58) Field of Search ..... 434/403, 429; 273/153 R, 156, 157 R, 160, 282.1; 446/69, 75

(56) References Cited

U.S. PATENT DOCUMENTS 2,861,358 A * 11/1958 Ward ..... 434/184
4,479,651 A * 10/1984 LaFleur ..... 273/157 R
4,534,563 A * 8/1985 Guenther ..... 273/157 R
4,609,356 A * 9/1986 Gilden et al. ..... 434/259
5,190,287 A * 3/1993 Ishiyama ..... 273/156
5,205,557 A * 4/1993 Kuo ..... 273/153 S
5,362,054 A * 11/1994 Ashemimry ..... 273/157 R
5,787,622 A * 8/1998 Green et al. ..... 40/621

* cited by examiner

*Primary Examiner*—Jacob K. Ackun, Jr.
(74) *Attorney, Agent, or Firm*—Pro-Techtor International Services

(57) ABSTRACT

A combination puzzle toy includes a case defining a top open chamber having a flat bottom surface, and a plurality of blocks to be inserted into the top open chamber and supported on the flat bottom surface of the top open chamber and coupled to one another in a flush manner to form one of a number of combinations, each block being formed of a flat rectangular first block member and a flat rectangular second block member asymmetrically fixedly arranged in a stack.

2 Claims, 6 Drawing Sheets

COMBINATION PUZZLE TOY

BACKGROUND OF THE INVENTION

1. Field of the Invention

The present invention relates to a puzzle toy and, more particularly, to a combination puzzle toy that can be arranged to form one of a number of combinations.

2. Description of the Related Art

FIGS. 1 and 2 show a combination puzzle toy A according to the prior art. According to this design, the combination puzzle toy A is comprised of a plurality of flat toy elements 100 of different geographical shapes that can be matched with one another to form a pattern (combination). Because the combination puzzle toy A can be assembled to form only one combination, the child remembers the way to assemble the combination after few trials, and becomes tired of play the combination puzzle toy A when knows the way to assemble the combination.

SUMMARY OF THE INVENTION

The present invention has been accomplished under the circumstances in view. It is the main object of the present invention to provide a combination puzzle toy, which trains the player's metal ability.

It is another object of the present invention to provide a combination puzzle toy, which trains the player to endure trouble.

According to one aspect of the present invention, the combination puzzle toy is comprised of a case and a plurality of blocks. The case defines a top open chamber, which has a flat bottom surface. The blocks are to be inserted into the top open chamber and supported on the flat bottom surface of the top open chamber and coupled to one another in a flush manner to form one of a number of combinations. Each block comprises a flat rectangular first block member and a flat rectangular second block member asymmetrically fixedly arranged in a stack.

According to another aspect of the present invention, the combinations include one combination where the flat rectangular first block member of at least one of the blocks is respectively disposed in contact with the flat bottom surface of the top open chamber, and the rectangular second block members of the other blocks are respectively disposed in contact with the flat bottom surface of the top open chamber.

DETAILED DESCRIPTION OF THE PREFERRED EMBODIMENT

Figure 1:
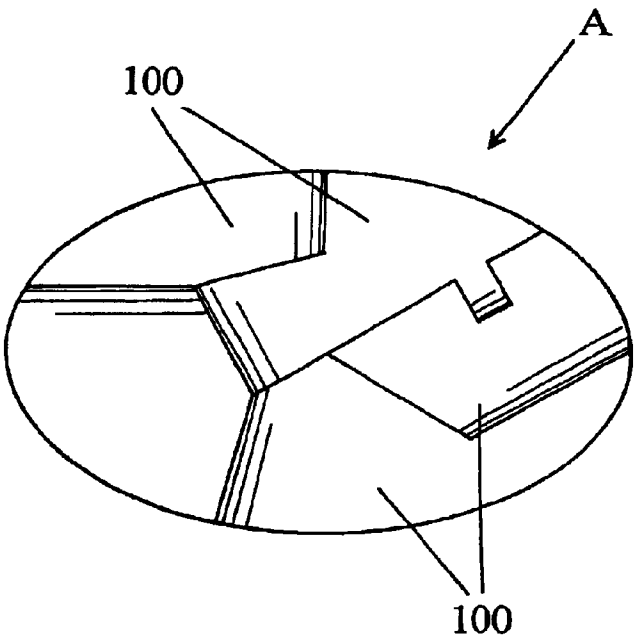
Fig.1(Prior Art)
FIG. 1 is a plain view showing a combination puzzle toy assembled according to the prior art.
Figure 2:
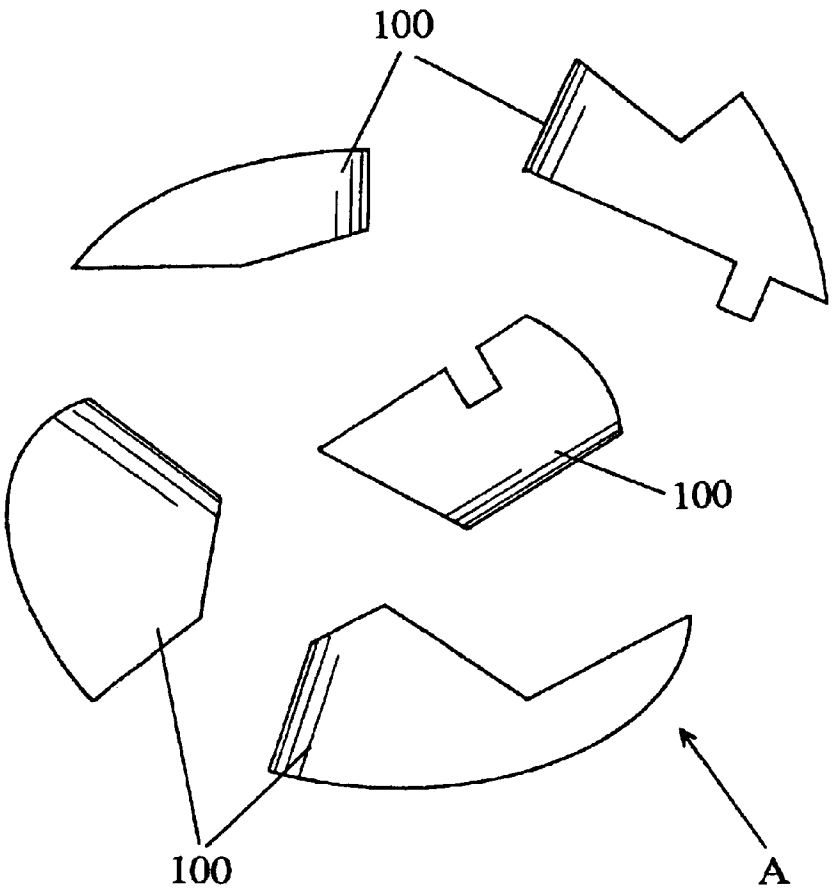
Fig.2(Prior Art)
FIG. 2 is an exploded view of the combination puzzle toy shown in FIG. 1.
Figure 3:
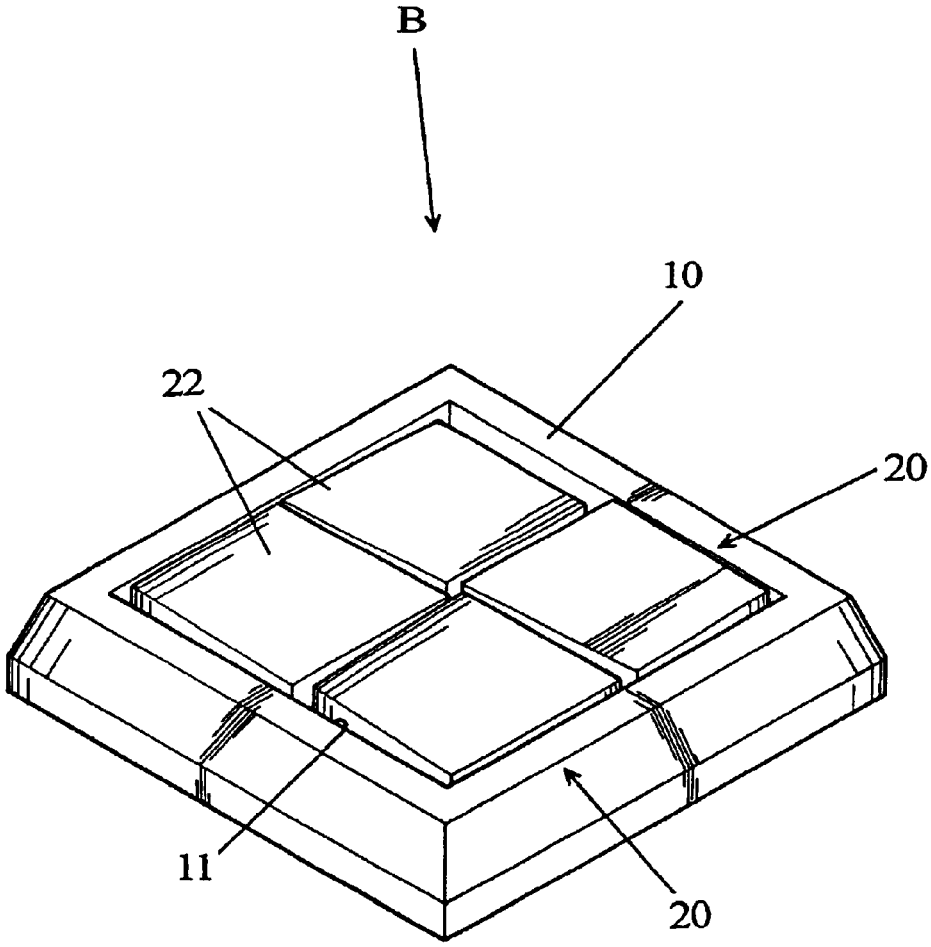
FIG. 3 is an elevational assembly view of a combination puzzle toy according to the present invention.
Figure 4:
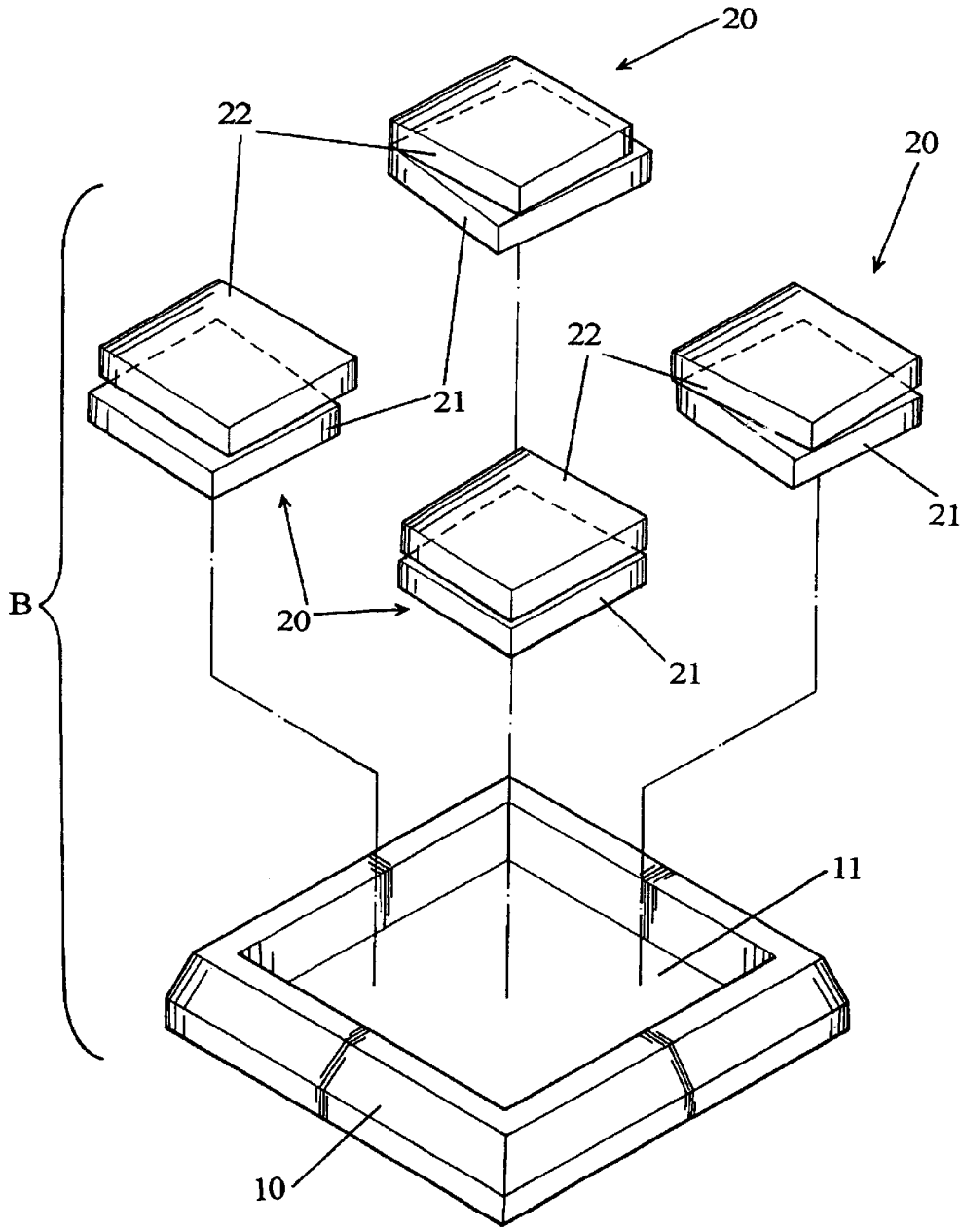
FIG. 4 is an exploded view of the combination puzzle toy according to the present invention.

Referring to FIGS. 3 and 4, a combination puzzle toy B is shown comprising a case 10 and a plurality of blocks 20. The case 10 defines a flat top open chamber 11 adapted to accommodate the blocks 20. The blocks 20 each are comprised of a flat rectangular first block member 21 and a flat rectangular second block member 22 asymmetrically fixedly arranged in a stack.

Figure 5:
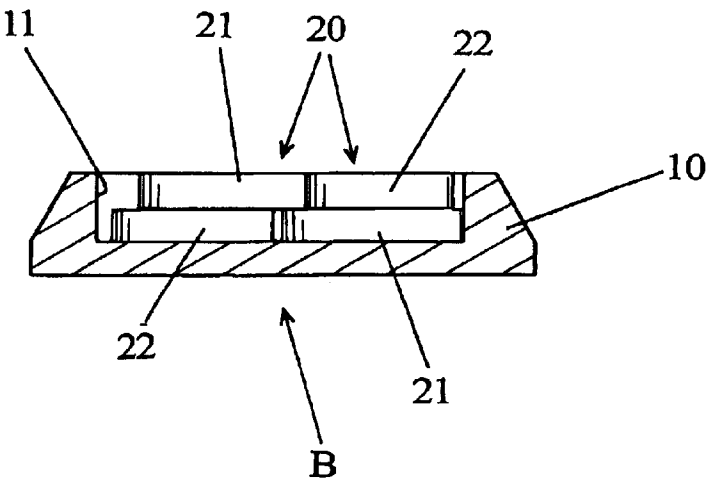
FIG. 5 is a sectional assembly view showing one combination of the combination puzzle toy according to the present invention.
Figure 6:
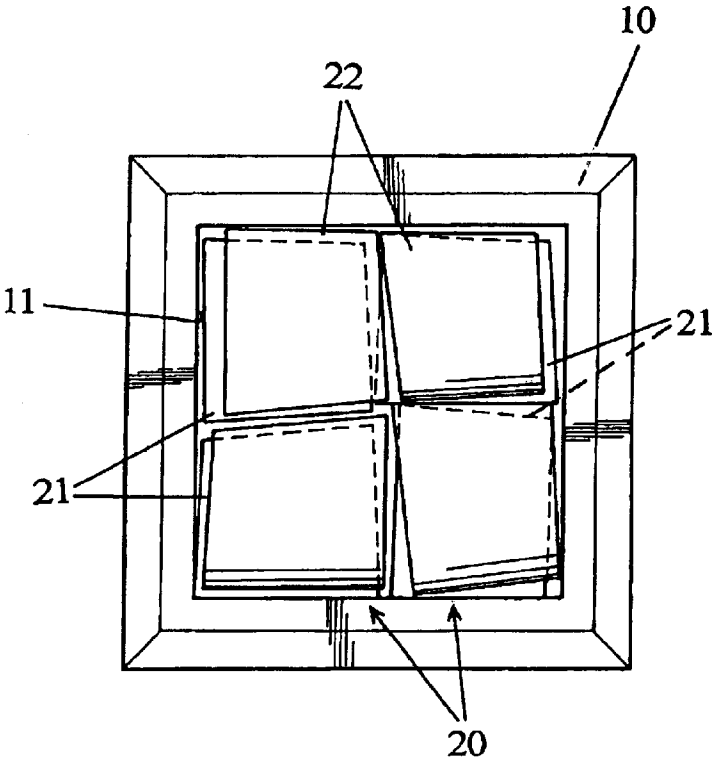
FIG. 6 is a top plain view of the combination puzzle toy according to the present invention.
Figure 7:
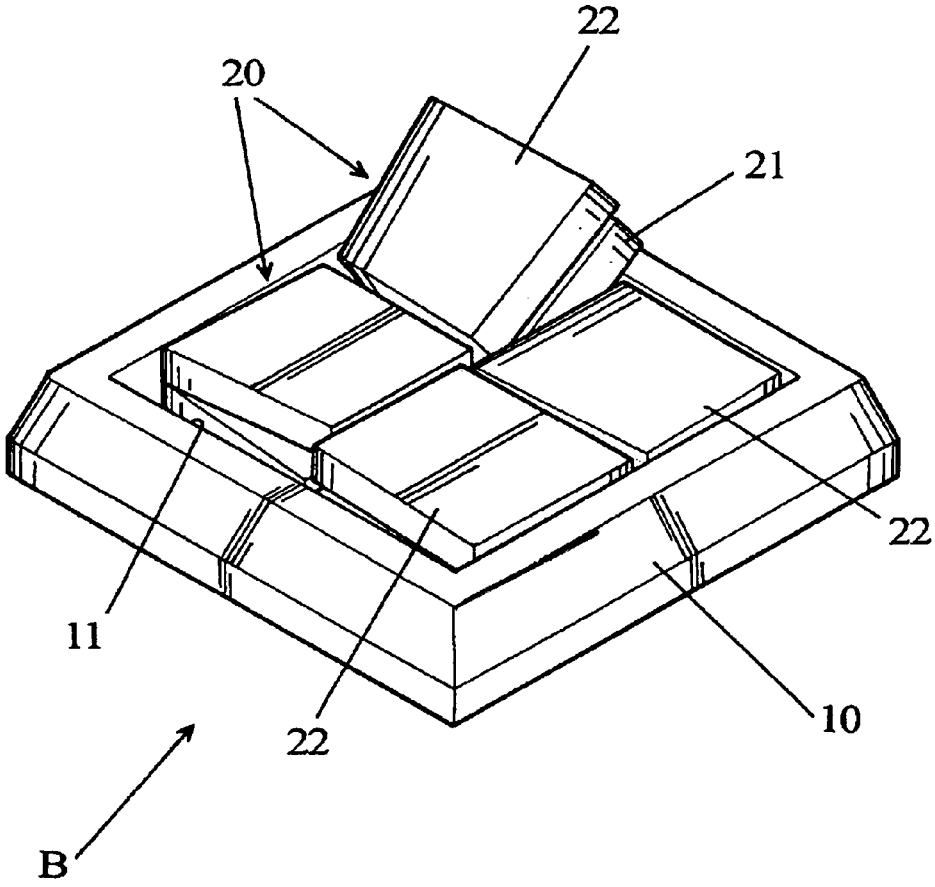
FIG. 7 illustrates a wrong combination example of the combination puzzle toy according to the present invention.
Figure 8:
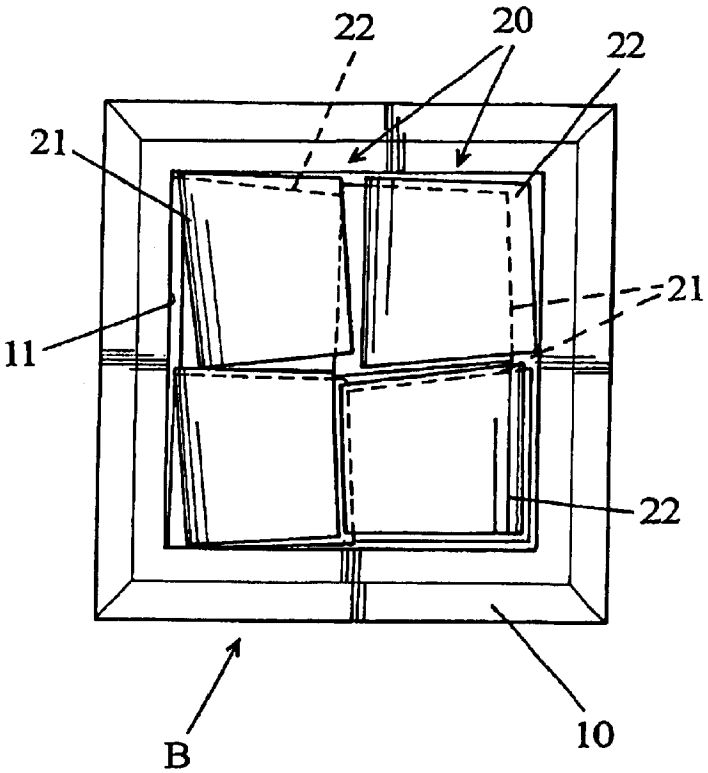
FIG. 8 is a plain view showing another correct combination example of the combination puzzle toy according to the present invention.
Figure 9:
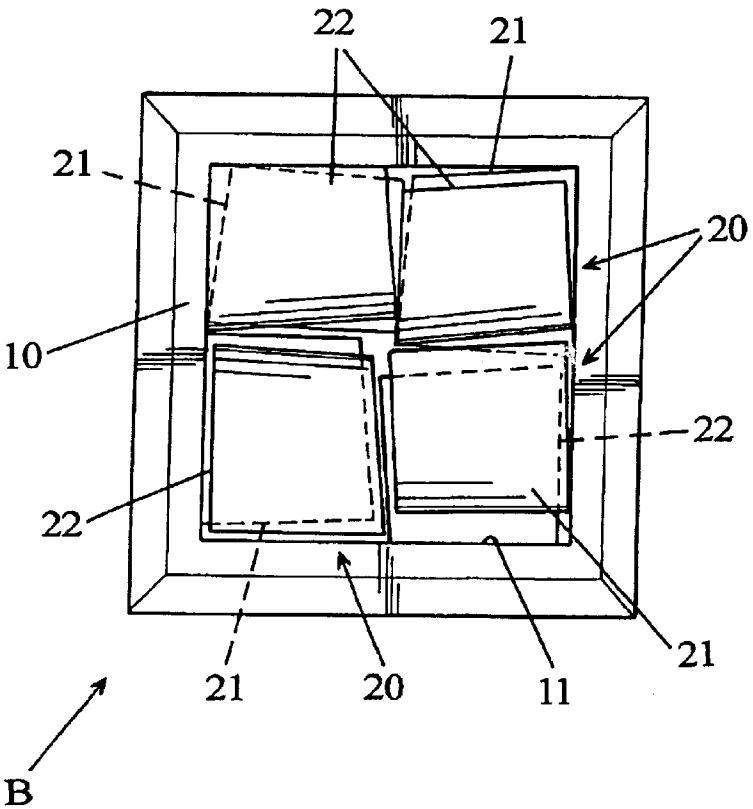
FIG. 9 is a plain view showing still another correct combination example of the combination puzzle toy according to the present invention.

When playing the combination puzzle toy B, the blocks 20 are put in the flat top open chamber 11 (see FIG. 3). If the blocks 20 are all set in the flat top open chamber 11 of the case 10 and coupled to one another, the flat rectangular first block members 21 of the blocks 20 are kept in close contact with the flat bottom surface of the flat top open chamber 11, and the flat rectangular second block members 22 of the blocks 20 are disposed in flush with one another (see FIG. 6). The area of the bottom surface of the flat top open chamber 11 is slightly greater than the area of the bottom side of the assembled blocks 20, increasing the difficulty of accurately putting the blocks 20 in the flat top open chamber 11 of the case 10. In case one block 20 cannot be completely inserted into the inside of the flat top open chamber 11 (i.e., the flat rectangular second block member 22 of one block 20 is not maintained in flush with the flat rectangular second block members 22 of the other blocks 20), it means a wrong combination (see FIG. 7), and the blocks 20 must be rearranged. There is a correct combination where the flat rectangular second block member 22 of at least one block 20 is disposed in contact with the bottom surface of the flat top open chamber 11, and the flat rectangular first block members 21 of the other blocks 20 are disposed in contact with the bottom surface of the flat top open chamber 11 (see FIG. 5). FIGS. 8 and 9 show other two correct combinations of the combination puzzle toy B.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A combination puzzle toy comprising a case, said case having a top open chamber, said top open chamber having a flat bottom surface, and a plurality of blocks to be inserted into said top open chamber and supported on said flat bottom surface of said top open chamber and coupled to one another in a flush manner to form one of a number of combinations, said blocks each comprising a flat rectangular first block member and a flat rectangular second block member asymmetrically fixedly arranged in a stack.

2. The combination puzzle toy as claimed in claim 1, wherein said combinations include one combination where the flat rectangular first block member of at least one of said blocks is respectively disposed in contact with the flat bottom surface of said top open chamber, and the rectangular second block member of the other of said blocks is respectively disposed in contact with the flat bottom surface of said top open chamber.

* * * * *